US008235618B2

(12) United States Patent
Peck et al.

(10) Patent No.: US 8,235,618 B2
(45) Date of Patent: Aug. 7, 2012

(54) SAMPLE DOSE WITH APPLICATOR

(75) Inventors: Christophe Peck, Saint Leger de Montbrun (FR); Guy-Noël Sibileau, Saint Varent (FR); Phillippe Moussion, Misse (FR)

(73) Assignee: Socoplan, Saint Jean de Thouars (FR)

( * ) Notice: Subject to any disclaimer, the term of this patent is extended or adjusted under 35 U.S.C. 154(b) by 662 days.

(21) Appl. No.: 12/439,318

(22) PCT Filed: Aug. 28, 2007

(86) PCT No.: PCT/FR2007/001404

§ 371 (c)(1),
(2), (4) Date: May 7, 2009

(87) PCT Pub. No.: WO2008/025897

PCT Pub. Date: Mar. 6, 2008

(65) Prior Publication Data

US 2009/0304433 A1 Dec. 10, 2009

(30) Foreign Application Priority Data

Aug. 29, 2006 (FR) ..... 06 07581

(51) Int. Cl.
*B43K 5/14* (2006.01)

(52) U.S. Cl. ..... 401/132; 206/209

(58) Field of Classification Search ..... 401/132–135, 401/121–122, 125–130; 206/209; 132/313, 132/317; 604/3

See application file for complete search history.

(56) References Cited

U.S. PATENT DOCUMENTS

| | | | | | |
|---|---|---|---|---|---|
| 1,602,531 | A | * | 10/1926 | Itoh | 132/308 |
| 2,547,779 | A | | 4/1951 | Renyck | |
| 3,086,647 | A | * | 4/1963 | Krezanoski | 206/363 |
| 4,889,228 | A | | 12/1989 | Gueret | |
| 4,982,838 | A | | 1/1991 | Fitjer | |
| 5,112,152 | A | * | 5/1992 | McBride | 401/132 |
| 5,316,400 | A | * | 5/1994 | Hoyt et al. | 401/132 |

(Continued)

FOREIGN PATENT DOCUMENTS

DE 3122237 1/1983

(Continued)

OTHER PUBLICATIONS

International Search Report dated Mar. 6, 2008, from corresponding PCT application.

*Primary Examiner* — David J. Walczak
*Assistant Examiner* — Jennifer C Chiang
(74) *Attorney, Agent, or Firm* — Young & Thompson

(57) ABSTRACT

Device for distributing a low volume or dose of product includes a reservoir defined by a joining area of two groups and that contains a distribution orifice, and an applicator including a grasping organ and a distribution organ composed of a rod, whose end is fitted with a distribution nozzle and whose other end is included in the grasping organ, at least one of the groups being a shell including a cavity having a collar that the joining area in part of and at least one of the groups has a collar including a trough; the distribution orifice communicating with the reservoir by a neck formed by the space between the two groups, the trough forming its wall at least partially; the neck including a breakable structure, breaking an area opening the orifice.

15 Claims, 4 Drawing Sheets

U.S. PATENT DOCUMENTS

| | | | | |
|---|---|---|---|---|
| 5,660,273 | A * | 8/1997 | Discko, Jr. | 206/229 |
| 5,862,818 | A * | 1/1999 | Marinelli | 132/312 |
| 6,062,757 | A | 5/2000 | Gueret | |
| 7,008,133 | B2 * | 3/2006 | Ashe et al. | 401/132 |
| 7,131,784 | B2 * | 11/2006 | Lee et al. | 401/128 |
| 8,109,387 | B2 * | 2/2012 | Sogaro | 206/361 |
| 2002/0185401 | A1 | 12/2002 | Duquet et al. | |
| 2003/0015605 | A1 | 1/2003 | Garcia et al. | |
| 2004/0253039 | A1 * | 12/2004 | Stenton | 401/132 |
| 2006/0283728 | A1 * | 12/2006 | Patrick et al. | 206/229 |
| 2007/0189835 | A1 * | 8/2007 | Klocke et al. | 401/133 |

FOREIGN PATENT DOCUMENTS

| | | |
|---|---|---|
| EP | 0 171 983 | 2/1986 |
| EP | 0 323 336 | 7/1989 |
| EP | 0 543 406 | 5/1993 |
| FR | 2 625 083 | 6/1989 |
| FR | 2 738 126 | 3/1997 |
| FR | 2 879 418 | 6/2006 |
| WO | 98/34512 | 8/1998 |

* cited by examiner

SAMPLE DOSE WITH APPLICATOR

The invention relates to (i) a device for distributing a small volume or a sample dose of product—liquid, more or less solid or viscous—that is to be applied: cosmetic product such as mascara, lipstick, nail polish, a hygiene product or medication, (ii) a process for the production of this device, and (iii) an installation that makes possible the implementation of said process.

The documents FR-A-2 738 126 and U.S. Pat. No. 4,982,838 disclose sample dose distributors of the same structure as the conventional make-up units but more compact in size. These distributors, provided with an applicator, comprise a container that comprises, if necessary, a blotting element and a cap for screwing or ratcheting the reservoir closed, connected to an element for distributing the make-up. With a structure that is as complex as the conventional distributors, these sample distributors have a very high cost that makes their use unsuitable when the cost factor is decisive. In addition, during their production, the assembly of the container as well as that of the blotting element is carried out before the insertion of the distribution element. In order to be functional, the distribution element is to be immersed in the sample dose. However, the height of the container exceeds that of the distribution unit only by very little. Whereas the filling of the container before the insertion of the distribution element increases the risks of overflow, the preliminary impregnation of the element before its insertion into the container proves to be a bad idea in practice, whereby the sample dose is most often inadequate for allowing its use under optimum conditions, and whereby the impregnation of the distribution element is all the more inadequate when the distributor is equipped with a blotting element since it is responsible for a blotting of the distribution unit during its insertion into the reservoir.

For the purpose of preventing this problem, devices for application of sample doses formed by an applicator that is contained in packaging are known. The documents U.S. Pat. No. 2,547,779 or EP-A-0 171 983 describe a packaging that consists of flexible sheets that are sealed together at their edges. In the document FR-A-2 625 083, the packaging is formed by two sheets made of plastic that are partially welded together and in which the applicator is placed. The packaging has two separate zones: a first part that can be opened and a second that contains the distribution element of the applicator, whereby the two parts are separated by a constriction zone. However, these distributors have the drawback that the applicator is entirely included in the packaging that takes the place of the reservoir. Under these conditions, when the device is stored in a position other than vertical with the distribution element directed downward, the make-up dose according to its amount and its density can contaminate the gripping element of the applicator that then becomes unusable.

The document WO 98/34512 describes a disposable device for a sample. It comprises three separate parts: a reservoir, a closing part and the applicator, itself consisting of several parts. This structure proves to be too complex for the application being considered.

The document US 2002/0185401 relates to a perfume test package. It involves an application that is completely different from the one in which the invention is interested, namely a liquid product that is more or less solid or viscous, quite especially a product that is to be applied: a sample of a cosmetic product such as mascara, lipstick, nail polish, or a hygiene product or a medication.

The document FR 2 879 418 describes an applicator distributor of a product with a flexible reservoir. This distributor rests on the principle of sharing a two-cavity pack. This principle is not the one that is used by the invention.

The technical problem of the invention is therefore to prevent the preceding drawbacks while meeting certain requirements of air-tightness and solidity that allow a broad distribution of samples. Furthermore, the device is to meet requirements linked to the distribution of samples, namely to be of simple production, with a minimum amount of parts, be producible on a large scale and at low cost since in a general way, the samples are not intended for sale but for a single use for a single dose, and, finally, to be for simple use, which is practical and efficient since this device has as its purpose to promote the use of a product.

For this purpose, according to a first aspect, the invention proposes a device for distribution of a small volume or a sample dose of product—liquid, more or less solid or viscous—that is to be applied: a cosmetic product such as mascara, lipstick, nail polish, hygiene product or medication, which comprises:

- A reservoir that is delimited by a zone for interlocking two units and that comprises a hole for distribution of the product that is to be applied,
- And an applicator that comprises a gripping element and a distribution element that consists of a rod that passes through the distribution hole, whose first end is equipped with a nozzle for distributing the cosmetic composition that is located in the reservoir and whose second end is included in the gripping element in which:
- At least one of the units is a shell that comprises a cavity that has a transverse collar that is part of the interlocking zone and whereby at least one of the units has a transverse collar that comprises a trough in the latter,
- The distribution hole is in fluid communication with the reservoir via a spout that is formed by the space that is left between the two units after interlocking, whereby the trough at least partially forms a wall of the spout,
- The spout comprises a divisible structure, such that the breaking of a small interlocking zone opens the distribution hole,
- The spout has a narrow and relatively circular structure so as to form a blotting element of the applicator,
- The distribution hole is sealed by a sealing element that is formed by the interlocking of at least one expansion of the transverse collar,
- The gripping element of the applicator is formed by the sealing element.

According to a first embodiment, the first and second units consist of one piece and are separated by a folding zone, whereby the thus constituted one-piece structure is made opened flat and then folded, so that one unit comes on top of the other for the purpose of being made interlocking.

According to a second embodiment, the first and second units are separate structures.

According to one embodiment, the second unit is a sheet that has a relatively flat surface and that is at least adequate for forming the reservoir by peripherally interlocking with the shell.

According to one embodiment, the first unit is a first shell and the second unit is a first shell.

According to one embodiment of the device, its opening is produced by torsion of the sealing element relative to the reservoir around the axis that is formed by the applicator by the breaking of the small interlocking zone.

According to one embodiment of the device, its opening comprises the peeling of the sheet over at least a portion of the shell.

According to other characteristics, the second end of the rod is equipped with an anti-rotational means that prevents the rotation of the rod in the gripping element during the opening of the device. This anti-rotational means can be a V-shaped structure or an elbowed structure of the second end of the rod.

According to a second aspect, the invention relates to a unit that is formed by assembling several devices for distribution of a dose-sample as just described.

According to one embodiment, at least two devices for distribution of a dose-sample are assembled side by side.

According to one embodiment, the devices for distribution of a dose-sample are separated by a tear line.

According to one embodiment, at least two devices for distribution of a dose-sample are connected by a portion of their reservoir, such that said devices for distribution of a dose-sample are undetachable.

According to a third aspect, the invention relates to a process for production of a device as was described above, which comprises the following stages:

The first and second units are produced,

The distribution element is arranged on one of the units,

Said unit is filled, whereby the order of stages for filling and arranging the distribution element is not important, The two units are interlocked so as to form the reservoir and the applicator, whereby the distribution nozzle is in the inside space of the reservoir.

Finally, according to a fourth aspect, the invention relates to an installation for the production of a device as it was described above, which comprises the following means:

Means for production of the first and second units,

Means for arrangement of the distribution element on one of the units,

Means for filling the reservoir,

And means of interlocking the two units so as to form the reservoir.

Other objects and advantages of the invention will emerge during the following description, made with reference to the accompanying drawings, in which.

Figure 1:
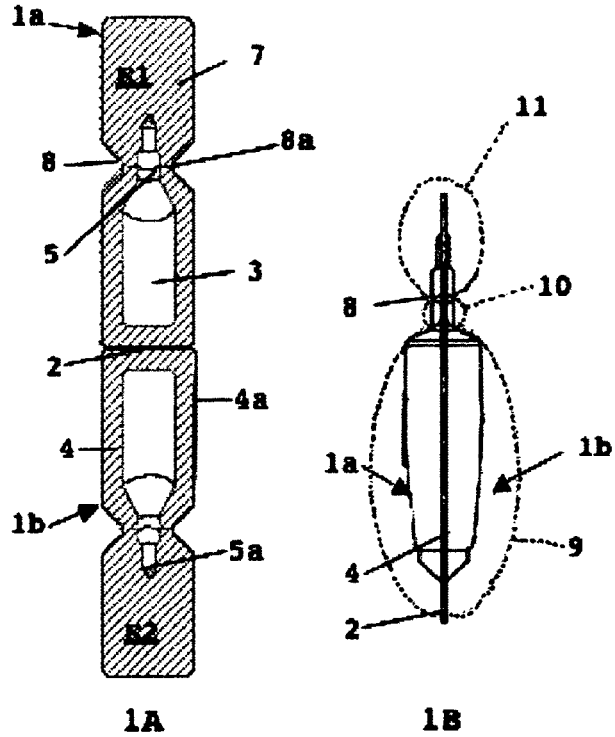
FIGS. 1A and 1B illustrate a top view of an unfolded shape of a first variant of the device according to the invention that consists of two shells and a side view of the first folded variant.

The device comprises two units E1 and E2 that are interlocked and that, according to a first variant, are identical. In this case, the units E1 and E2 are two heat-formed shells 1*a* and 1*b* that are connected by a folding zone 2 so that the folding of one unit on top of the other and their interlocking make possible the formation of the device. The two shells la and lb can be structures that are separate from one another before interlocking.

A cavity 3 that is partially surrounded by an interlocking zone 4*a* is provided in the shell 1. The interlocking zone 4*a* is peripheral to the cavity 3 and is located in particular at a transverse collar 4 of the shell 1. The collar 4 makes it possible to increase the contact zone between the two units E1 and E2 and thus improves the resistance and the air-tightness of the sealing. The interlocking of the two shells 1*a* and 1*b* is therefore carried out at collars 4 of each shell 1*a* and 1*b*.

The cavity 3 of the shell 1 is extended by a trough 5 that is open at one end into the cavity 3 and recessed at its second end 5*a*. The interlocking zone 4*a* surrounds the unit that is formed by the cavity 3 and the trough 5. The interlocking zone 4*a* that surrounds the trough 5 is reduced at a bottleneck zone 8 for reduced interlocking located between the expansion 7 and the transverse collar 4. A scoring line 8*a* passes through said bottleneck zone of reduced interlocking 8.

The folding zone 2 of the one-piece structure is on the free edge opposite to the trough 5 of the collar 4 in the case that is illustrated in FIG. 1A, but it can just as well be considered on any of the free edges of the shells 1*a* and 1*b*.

The sample dose distribution device is formed by the interlocking of the two units E1 and E2 after the first unit E1 is folded on the second unit E2, as illustrated in FIG. 1B. The interlocking of the transverse collars 4 of the shells 1*a* and 1*b* brings about a superposition of the cavities 3 of each unit that form a reservoir 9. The portions of troughs 5 that are located between the cavities 3 and the scoring lines 8*a* form a divisible structure that is equipped with a sectional zone 8 that promotes a separation of the sealing element 11 from the spout 10 and by the same token promotes the opening of the device.

Figure 2:
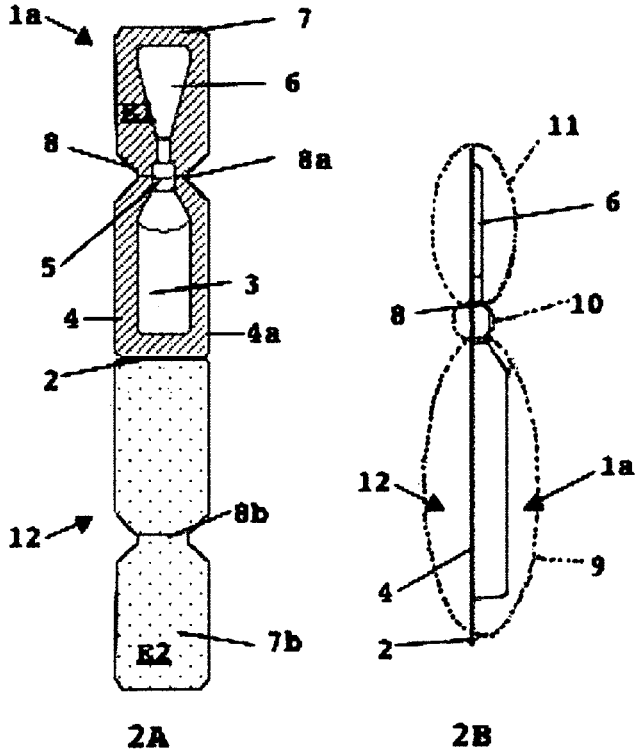
FIGS. 2A and 2B illustrate a top view of an unfolded form of a second variant of the device according to the invention that consists of a shell and a sheet, and a side view of the second folded variant.
Figure 3:
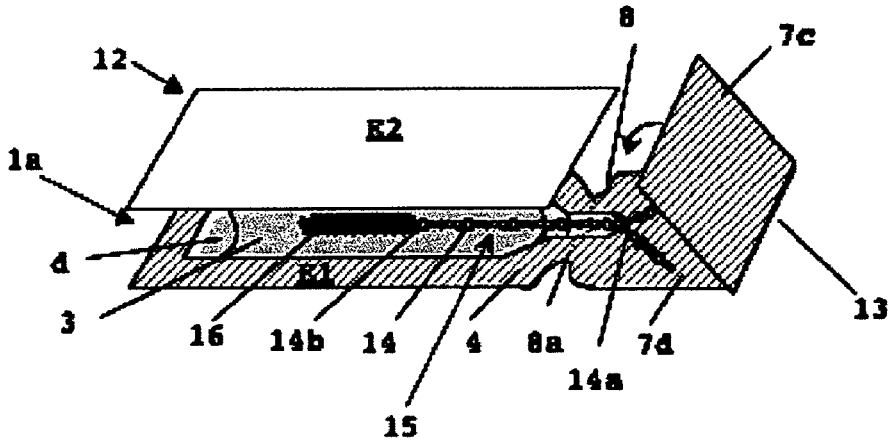
FIG. 3 is a perspective view of the upper face of a third variant of the device that consists of two separate units: a shell and a sheet before interlocking.

In a second variant, the second unit E2 is a sheet 12. The sheet 12 belongs either to a one-piece structure as illustrated in FIG. 2A or consists of a structure that is separated from the shell 1 as illustrated in FIG. 3. The sheet 12 is welded on its periphery to the welding zone 4*a* of the collar 4 of the shell 1. In the variant that is illustrated in FIG. 2A, the trough 5 of the shell 1 brings into contact the cavity 3 and a cell 6 that is hollowed out in an expansion 7 of the transverse collar 4. In contrast, the sheet 12, like the shell 1, comprises an expansion 7*b* that corresponds to the expansion 7 of the shell 1. The expansion 7*b* is relatively flat in the variant that is illustrated in FIG. 2A, but it can comprise a cell or can be hollowed out from another formation. The expansion 7*b* is equipped with a scoring line 8*b* that corresponds to the scoring line 8*a* of the expansion 7 of the shell 1.

The interlocking of the one-piece structure is carried out after the sheet 12 is folded on the shell 1 so as to constitute the device that is illustrated in FIG. 2B. Whereby the reservoir 9 of the device consists of the cavity 3 that is sealed by a portion of the sheet 12, the trough 5 that is sealed at its edges with the sheet 12 on the one hand forms the spout 10 and, on the other hand, in association with the expansions 7 and 7*b*, forms the sealing element 11, whereby the section zone 8 separates the spout 10 from the sealing element 11.

The sheet 12 that forms the second unit E2 that is separate from the first unit E1 can be removed from expansion 7*b* (see FIG. 3). In this variant, the expansion 7 of the shell 1 is equipped with a folding zone 13 that determines two portions 7*c* and 7*d*. The sealing element 11 is obtained by the interlocking of the two portions 7*c* and 7*d* of the expansion 7 of the shell 1 only. The expansion 7 of the collar 4 of the shell 1 according to the variant that is illustrated in FIG. 3 is relatively flat and is lacking in cells, whereby the end 5*a* of the trough 5 is recessed on the side of the expansion 7 of the collar 4 of the shell 1.

The sealing element 11 is obtained by interlocking of two portions 7*c* and 7*d* of the expansion 7 between which is included one end 14*a* of a sample distribution element 15.

The distribution element 15 comprises a distribution nozzle 16 that is held by a rod 14 that connects the distribution nozzle 16 by a first end 14*b* to the sealing element 11 by a second end 14*a*.

The units E1 and E2 are made of flexible plastic material or any other material that can allow a shell to be obtained by molding, injection or heat-forming. The sheets 12 can be made of plastic material, metal material, carbon-containing material or any structure that makes it possible to obtain a device with a hermetic reservoir 9 after interlocking with the shell 1.

Figure 4:
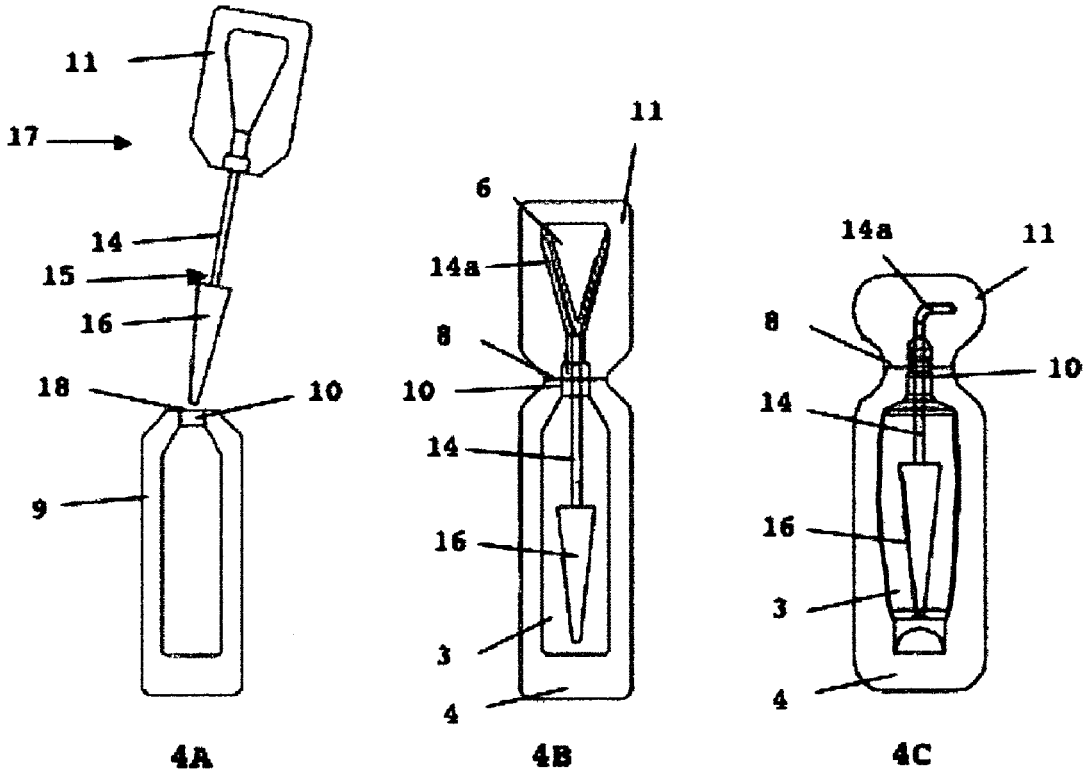
FIGS. 4A, 4B and 4C are head-on views of the second variant of the device according to FIG. 2 that is open with the applicator outside of the device, the second variant of the device according to FIG. 2 whose applicator is seen through a transparency and the first variant of the device according to FIG. 1 whose applicator is seen through a transparency.

Before the folding and the interlocking of the units E1 and E2, a distribution element 15 is placed on the unit E1. The filling of the cavity 3 of the shell 1 by a sample dose d can be carried out before or after the deposition of the distribution element 15 on the unit E1. The units E1 and E2 are then superposed before their interlocking as illustrated in FIG. 4A. The interlocking of the two units E1 and E2 makes it possible to obtain a device that comprises an applicator 17 that consists of said distribution element 15 and said sealing element 11 that constitutes a gripping element for the applicator 17. The distribution element 15 itself comprises the rod 14 that holds the distribution nozzle 16 at its end 14*b*.

Distribution nozzle 16 is defined as a brush or a comb with a flexible arm when the sample that is contained in the reservoir is mascara, a brush in the case of nail polish, a foam nozzle for lipstick, and even a flat and flexible nozzle within the framework of a cream that is to be applied, such as foundation or any other nozzle that can allow a suitable distribution of a cosmetic or any other substance that is to be applied.

In general, the rod 14 can be made of plastic material or metal and can be connected to the nozzle 16 by welding, ratcheting, interlocking, or gripping even in the case where the nozzle 16 is a brush, and can be the metal thread that has made it possible to constitute said brush.

To improve the holding of the rod 14 in the gripping element 11, the end 14*a* of the rod 14 is equipped with an anti-rotational means. The anti-rotational means of the second end 14*a* of the rod 14 can be V-shaped (FIG. 4B) or elbowed (FIG. 4C) or any other structure that prevents a rotation of the rod 14 in the gripping element 11. The end 14*a* can either be kept in the cell 6 that is provided in the expansion 7 (FIG. 4A) or directly included in the sealing and molded in the walls of the expansion 7. The fact that the end 14*a* of the rod 14 is held prevents any tilting or rotation of the rod 14 while the device is being opened and while the applicator 17 is being used.

Thus, the device comprises a minimum number of parts, which is a factor for facility of production and cost. This result is obtained by the fact that the material that forms the reservoir 9 completely or partially also forms the gripping part 11 and the blotter, without the necessity for another part.

Figure 5:
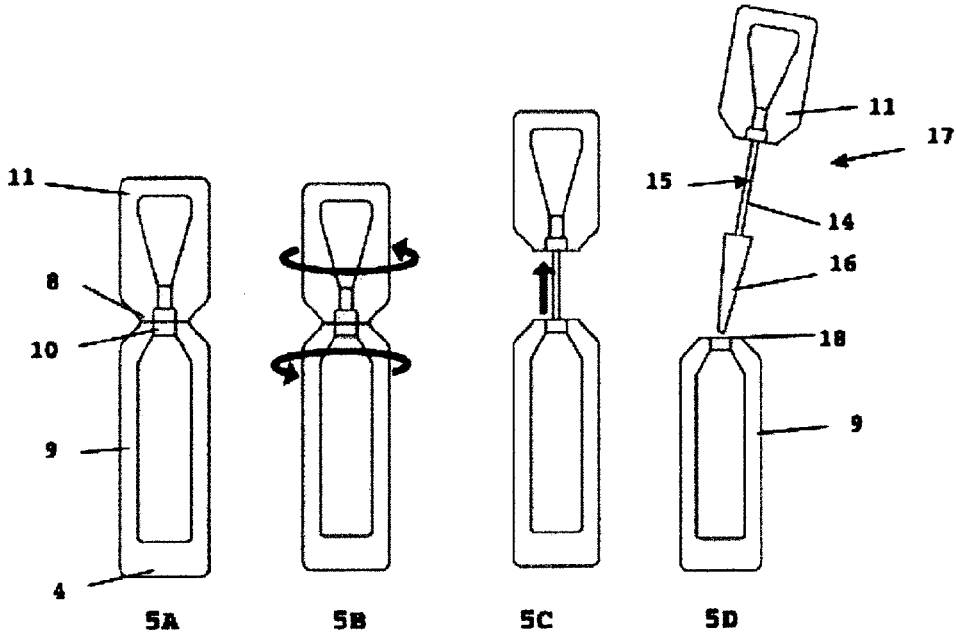
FIGS. 5A, 5B, 5C and 5D are head-on views that illustrate the opening stages of the second variant of the device of FIG. 1.

The opening of the sample dose distribution device is illustrated in FIG. 5 and is preferably carried out by the rotation of the sealing element 11 and the reservoir 9 around the axis of the distributor in opposite directions so as to break the section zone 8 and thus to open the distribution hole 18 of the device. This mode of use proves to be particularly advantageous when the nozzle is a brush or a paintbrush that requires a blotting before use. The blotting is performed by the spout 10 that forms a blotting element whose diameter can be adjusted based on the mold that is selected to form the heat-formed shell 1.

The opening of the device can be partially carried out by a peeling that precedes the breaking of the section zone 8 of a portion of the sheet 12 on the expansion 7; in the case of the variant that is illustrated in FIG. 3, the peeling that precedes the breaking of the section zone 8 is carried out at the reservoir 9 of the shell 1, followed by a breaking of the section one 8 by torsion or folding of the sealing element 11 to as to release the applicator 17 from the distributor. The breaking of the second zone 8 by folding the sealing element 11 without running the risk of altering the applicator 17 is made possible by the opening of the reservoir over all or part of its length by the peeling of the sheet 12. This embodiment proves to be particularly advantageous when the sample dose is in the form of powder or even a more or less solid form. Conversely, the breaking of the section zone 8 may precede the peeling of the sheet 12. This embodiment proves to be particularly advantageous when the sample dose is in powder form or in a more or less solid form. Conversely, the breaking of the section zone 8 may precede the peeling of the sheet 12. The peeling of a sheet 12 of the reservoir 9 can be considered when the blotting of the nozzle 16 is not necessary or when the size of the nozzle 16 is much larger than the diameter of the spout 10 of the device.

The distribution device can allow a closing that is consecutive to a first opening of the device by the use of a spout 10 and a section zone 8 that are suitable, allowing both an opening of the device by rotational torsion or refolding as well as a reclosing of the device by racheting or screwing, for example.

Figure 6:
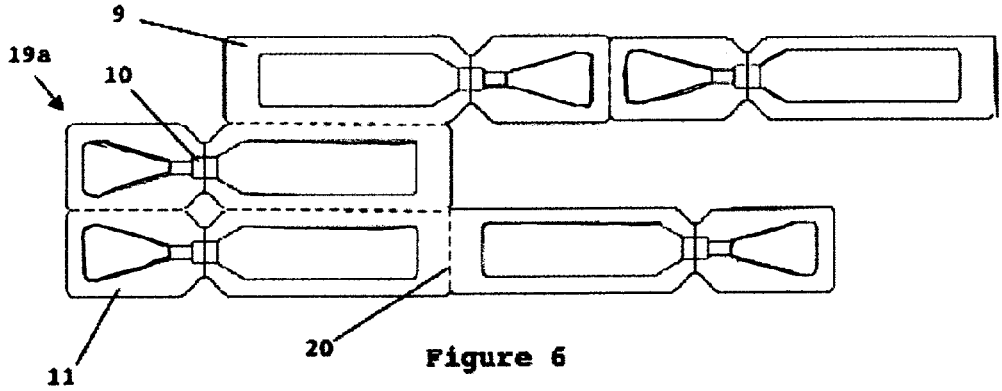
FIG. 6 is a top view of a small plate with separable devices.
Figure 7:
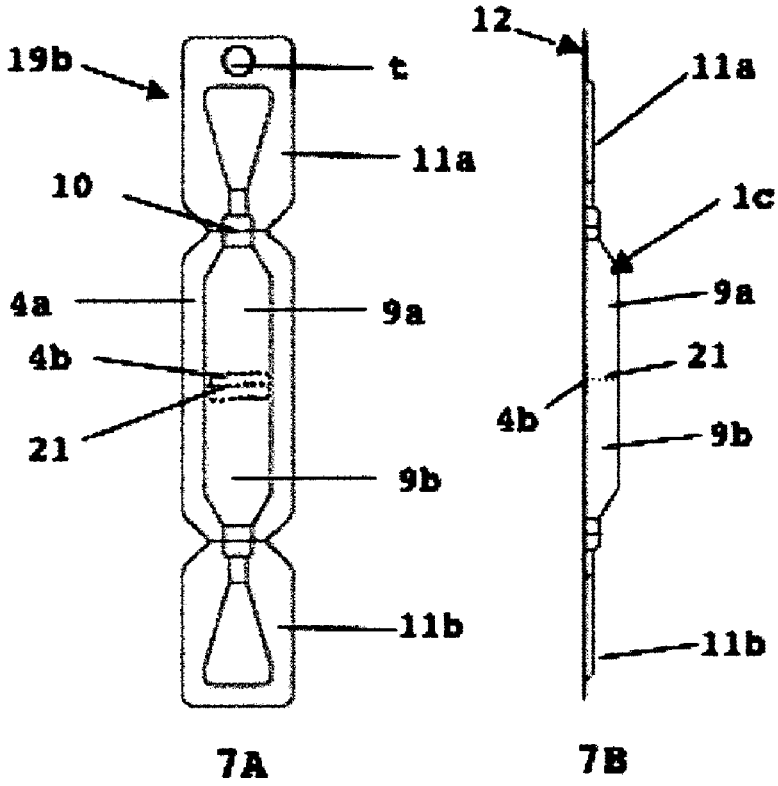
FIG. 7 is a top view of a unit of two inseparable devices.
Figure 8:
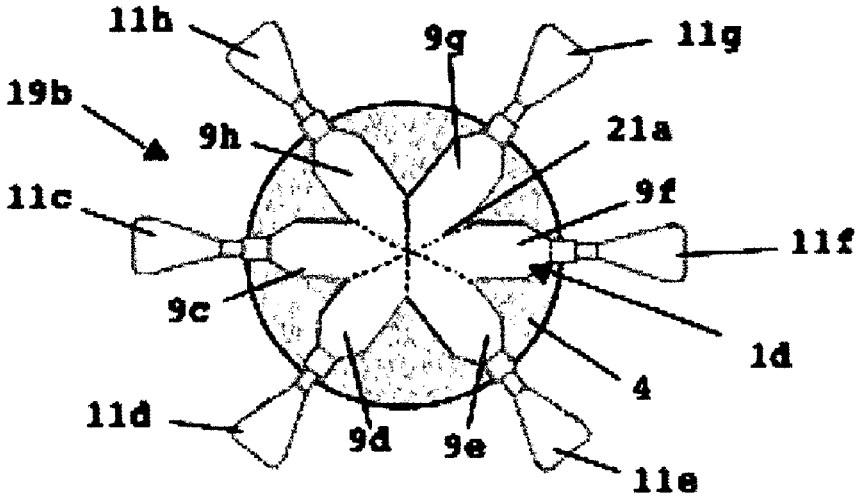
FIG. 8 is a top view of a unit of several inseparable devices.

The devices according to the invention can be distributed in the form of small plates 19*a* and 19*b* as illustrated in FIGS. 6 to 8. The devices can be organized parallel to one another, head to foot or in the same direction (FIG. 6). Tear lines 20 are provided whereas the devices can be detached before their use. The small plates with detachable devices 19 prove to be particularly practical so as to offer, for example, make-up kits that are coordinated, for example, for lipstick, nail polish, eye shadow, or mascara.

The devices can be organized into small plates 19*b* that are formed by a given number of non-detachable devices (see FIGS. 7 and 8). These small plates 19*b* of non-detachable devices are obtained from two units E1 and E2, whereby the unit E1 is a shell 1*c* or 1*d*, and the unit E2 can be a shell or sheet 12.

Although these small plates 19*b* offer several devices according to the invention, the unit E1 consists of a single shell 1*c* or 1*d*. Said shell 1*c* or 1*d* is equipped with several cavities that are separated by a central wall 21 or a group of walls 21*a* that make it possible to obtain airtight and separate reservoirs (9*a*, 9*b*, 9*c*, 9*d*, 9*e*, 9*f*, 9*g*, and 9*h*) that are illustrated in FIGS. 7 and 8 after the interlocking of the two units E1 and E2. The interlocking of the two units E1 and E2 is carried out at the interlocking zone 4*a* as well as the portion 4*b* of the collar 4 extending over the free edge of the central wall 21 (seen through a transparency in FIGS. 7A and 7B) or the group of central walls 21*a* (not illustrated) of the shell 1*c* or 1*d*. Each reservoir 9*a*, 9*b*, 9*c*, 9*d*, 9*e*, 9*f*, 9*g*, and 9*h* is equipped with a sealing element 11*a*, 11*b*, 11*c*, 11*d*, 11*e*, 11*f*, 11*g* and 11*h* and therefore a corresponding applicator. The small plates 19*b* with non-detachable devices make possible the distribution of several samples that have to be distributed and used together for a better effectiveness of a cosmetic or medical treatment, for example. These small plates 19*b* can themselves be integrated into small plates 19*a* with a larger size and separated by tear lines 20.

In the same small plate 19*a* or 19*b*, the characteristics of the variants of the devices can be freely combined, and the distribution nozzles 16 or the opening modes can be different and can be adapted to the samples that are contained in the devices.

So as to facilitate the shelving and therefore the distribution of the device, a hole t, such as a Euro hole, can be provided in the sealing element 11 (see FIG. 7A). Likewise, the shape of the sealing element 11 is variable and can be used as a PR element without thereby increasing the complexity of producing the device.

The invention claimed is:

1. A device for distribution of a dose-sample for testing a cosmetic composition that is to be applied, such as, typically, mascara, lipstick or nail polish, which comprises:

a reservoir (9; 9*a* to 9*h*) that is delimited by a zone (4*a*) for interlocking two units (E1 and E2) and that comprises a distribution hole (18) for distribution of the cosmetic composition, at least one (E1) of the units (E1 and E2) is a shell (1; 1*a* to 1*d*) that comprises a cavity (3) that has a transverse collar (4) that is part of a interlocking zone (4*a*), and at least one of the units (E1, E2) has a transverse collar (4) that comprises a trough (5), an applicator (17) that comprises a gripping element (11; 11*a* to 11*h*), provided with a rod (14) that passes through the distribution hole (18), the rod having a first end (14*b*) and second end (14*a*), the first end (14*b*) equipped with a nozzle (16) for the distribution of the cosmetic composition that is located in the reservoir (9; 9*a* to 9*h*), wherein, the distribution hole (18) is in fluid communication with the reservoir (9; 9*a* to 9*h*) via a spout (10) that is formed by the space that is left between the two units (E1 and E2) after interlocking, whereby the trough (5) at least partially forms a wall of the spout (10), wherein the spout (10) has a narrow and relatively circular structure so as to form a blotting element of the applicator (17), an element (11) for sealing the distribution hole (18) obtained by interlocked portions (7*c*, 7*d*) of an expansion (7) of the transverse collar (4) between which is included the second end (14*a*) of the rod (14), and a divisible structure provided to open the distribution hole (18), wherein, the rod (14) is held by the interlocked portions (7*c*, 7*d*) of the expansion (7), a second end (14*a*) of the rod being kept in and connected to the interlocked portions (7*c*, 7*d*) so that the sealing element (11) constitutes the gripping element of the applicator (17) to prevent any contamination of the gripping element with the cosmetic composition and any tilting or rotation of the rod (14) while the device is being opened and while the applicator (17) is being used, and the interlocking zone (4*a*) surrounds the trough (5) and is reduced at an interlocking zone (8) with a scoring line (8*a*) located between the expansion (7) and the traverse collar (4), forming the divisible structure, such that the breaking of the interlocking zone (8), by torsion, opens the distribution hole (18).

2. Device according to claim 1, wherein the first and second units (E1 and E2) are constituted by a one-piece structure and are separated by a folding zone (2), whereby the constituted one-piece structure is made opened flat and then folded, so that one unit (E1, E2) comes on top of the other (E2, E1) for the purpose of being made interlocking.

3. Device according to claim 1, wherein the first and second units (E1 and E2) are separate structures.

4. Device according to claim 1, wherein the second unit (E2) is a sheet (12) that has a surface that is relatively flat and at least adequate for the formation of the reservoir (9; 9*a* to 9*h*) by peripherally interlocking with the shell (1; 1*a* to 1*d*).

5. Device according to claim 1, wherein the first unit is a first shell (1; 1*a* to 1*d*), and the second unit (E2) is a first shell (1; 1*b*).

6. Device according to claim 1, wherein opening of the device is made by torsion of the sealing element (11; 11*a* to 11*h*) relative to the reservoir (9; 9*a* to 9*h*) around the axis that is formed by the applicator (17) by the breaking of the small interlocking zone (8).

7. Device according to claim 4, wherein opening of the device comprises the peeling of the sheet (12) over at least a portion of the shell (1; 1*a*; 1*b*).

8. Device according to claim 1, wherein the second end (14*a*) of the rod (14) is equipped with an anti-rotational means that prevents the rotation of the rod (14) in the gripping element (11; 11*a* to 11*h*) during the opening of the device.

9. Device according to claim 8, wherein the anti-rotational means is a V-shaped structure or an elbowed structure of the second end (14*a*) of the rod (14).

10. Unit that is formed by assembling several dose-sample distribution devices according to claim 1 that form a small plate (19).

11. Unit according to claim 10, wherein at least two dose-sample distribution devices are assembled side by side.

12. Unit according to claim 11, wherein the dose-sample distribution devices are separated by a tear line.

13. Unit according to claim 10, wherein at least two dose-sample distribution devices are connected by a portion of their reservoir, such that said dose-sample distribution devices are undetachable.

14. Process for the production of a device according to claim 1, comprising the following stages:

the first and second units (E1, E2) are produced, the distribution element (15) is arranged on one (E1) of the units, said unit (E1) is filled, whereby the order of stages for filling and arranging the distribution element is not important, and the two units (E1, E2) are interlocked so as to form the reservoir (9; 9*a* to 9*h*) and the applicator (17), whereby the distribution nozzle is in the inside space of the reservoir (9; 9*a* to 9*h*).

15. A device for distribution of a cosmetic dose-sample, comprising:

first and second units (El, E2);

at least one of the first and second units (El, E2) comprising a shell (1, 1*a* to 1*d*), the shell comprising a cavity (3) which is extended by a trough (5) and surrounded by an interlocking zone (4*a*), the interlocking zone being located at a transverse collar (4), the transverse collar (4) configured for increasing air-tightness of the first and second units (El, E2), one of the first and second units (El, E2) is located on top of the other of the first and second units, the first and second units being interlocked;

a reservoir (9, 9*a* to 9*h*) comprising i) a distribution hole (18) and ii) a spout (10), the reservoir being delimited by the interlocking zone (4*a*) communicating with the distribution hole (18) via the spout (10); and an applicator (17) comprising i) a gripping element (11) detachable from the reservoir, ii) a rod (14) having a first end (14*b*) and a second end (14*a*), the rod (14) equipped with a nozzle (16) at the first end (14*b*) for a distribution of a cosmetic composition located in the reservoir and passing through the distribution hole (18), iii) an expansion (7), and iv) a scoring line (8*a*), wherein, the trough (5) partially forms a wall of the spout (10) with a narrow and relatively circular structure to form a blotting element of the applicator (17), the interlocking zone (4*a*) is reduced at a interlocking zone (8) which is located between the expansion (7) and the transverse collar (4), the scoring line (8*a*) forms a divisible structure passing through the small interlocking zone (8), the gripping element (11) for sealing the distribution hole (18) is defined by interlocked portions (7*c*, 7*d*) of the expansion (7) and the second end (14*a*) of the rod (14), and the rod (14) is held by the interlocked portions (7*c*, 7*d*) of the expansion (7), and the second end (14*a*) of the rod (4) is kept in place connected to the interlocked portions (7*c*, 7*d*), thereby preventing any contamination of the gripping element with the cosmetic composition.

* * * * *